US009650880B2

(12) United States Patent
Bowley et al.

(10) Patent No.: US 9,650,880 B2
(45) Date of Patent: May 16, 2017

(54) WAVEFORM ANTI-STICK SLIP SYSTEM AND METHOD

(71) Applicant: Tesco Corporation, Houston, TX (US)

(72) Inventors: Ryan Thomas Bowley, Calgary (CA); Doug Christian Greening, Calgary (CA)

(73) Assignee: TESCO CORPORATION, Houston, TX (US)

( * ) Notice: Subject to any disclaimer, the term of this patent is extended or adjusted under 35 U.S.C. 154(b) by 476 days.

(21) Appl. No.: 14/244,556

(22) Filed: Apr. 3, 2014

(65) Prior Publication Data

US 2014/0305702 A1 Oct. 16, 2014

Related U.S. Application Data

(60) Provisional application No. 61/811,217, filed on Apr. 12, 2013.

(51) Int. Cl.

| | |
|---|---|
| ***E21B 44/04*** | (2006.01) |
| ***E21B 3/02*** | (2006.01) |
| ***E21B 44/00*** | (2006.01) |

(52) U.S. Cl.

CPC ..... *E21B 44/04* (2013.01); *E21B 3/02* (2013.01); *E21B 44/00* (2013.01)

(58) Field of Classification Search

CPC ..... E21B 44/04; E21B 3/02; E21B 44/00

See application file for complete search history.

(56) References Cited

U.S. PATENT DOCUMENTS

| | | | | |
|---|---|---|---|---|
| 6,050,348 | A | 4/2000 | Richarson et al. | |
| 6,918,453 | B2 * | 7/2005 | Haci | E21B 7/068 175/26 |
| 7,588,099 | B2 * | 9/2009 | Kracik | E21B 7/046 175/24 |
| 7,802,634 | B2 | 9/2010 | Boone | |
| 7,823,655 | B2 | 11/2010 | Boone et al. | |
| 8,146,680 | B2 * | 4/2012 | Mock | E21B 44/005 175/27 |

(Continued)

FOREIGN PATENT DOCUMENTS

NL WO 2012084886 A1 * 6/2012 ..... E21B 44/00

OTHER PUBLICATIONS

International Search Report & Written Opinion for International Application No. PCT/IB2014/060911 mailed Feb. 2, 2015.

(Continued)

*Primary Examiner* — Nicole Coy

(74) *Attorney, Agent, or Firm* — Fletcher Yoder, P.C.

(57) ABSTRACT

The present disclosure is directed to systems and methods for rotating a drill string to overcome issues related to static friction during drilling. An embodiment includes a drive system configured to rotate the drill string through variable angular displacements and at variable rotation speeds based on control signals received by the drive system, and a control system configured transmit the control signals to the drive system, wherein the control system is configured to generate the control signals based on pipe characteristics within the drill string and friction values associated with the drill string to establish a rotation pattern of the drive system to approach a desired effective reach of surface torque generated by the drive system on the drill string.

23 Claims, 7 Drawing Sheets

(56) References Cited

U.S. PATENT DOCUMENTS

| | | | | |
|---|---|---|---|---|
| 8,360,171 | B2 | 1/2013 | Boone et al. | |
| 8,950,512 | B2 * | 2/2015 | Nessjoen | E21B 44/00 175/24 |
| 9,145,768 | B2 * | 9/2015 | Normore | E21B 44/00 |
| 2004/0118608 | A1 * | 6/2004 | Haci | E21B 7/068 175/26 |
| 2011/0301924 | A1 | 12/2011 | Jeffryes | |
| 2012/0255778 | A1 * | 10/2012 | Reckmann | E21B 47/0006 175/26 |
| 2013/0277110 | A1 * | 10/2013 | Doris | E21B 44/00 175/24 |
| 2016/0047219 | A1 * | 2/2016 | Jeffryes | E21B 44/00 700/275 |

OTHER PUBLICATIONS

Halsey et al., "Torque Feedback Used to Cure Slip-Stick Motion," Proceedings of SPE Annual Technical Conference and Exhibition, Oct. 25, 1988, XP055164556, DOI: 10.2523/18049-MS, 6 pgs.

Tveitdal, Terje, "Torque & Drag Analyses of North Sea Wells Using New 3D Model," University of Stavanger, Jun. 15, 2011.

Mirhaj, Seyed Ahmad et al., "Improvement of Torque-and-Drag Modeling in Long-Reach Wells," University of Stavanger, Modern Applied Science, vol. 5, No. 5, pp. 10-28, Oct. 2011.

* cited by examiner 20
10
22
14
18
40
42
56
38
50
52
CONTROL SYSTEM
26
36
34
32
54
12
28
24
16
30

WAVEFORM ANTI-STICK SLIP SYSTEM AND METHOD

This application claims the benefit of U.S. Provisional Application No. 61/811,217, entitled "Waveform Anti-Stick Slip System and Method," filed Apr. 12, 2013, which is hereby incorporated by reference.

BACKGROUND

Embodiments of the present disclosure relate generally to the field of drilling and processing of wells. More particularly, present embodiments relate to a system and method for addressing stick slip during certain drilling operations. Stick slip may be generally defined as the jerking motion of downhole components or equipment, such as drill pipe, as it slides against the edges of a borehole. Stick slip is primarily related to an inability of a driller to keep a desired weight on the bit (WOB) to yield a desired rate of penetration and tool life. If drilling components (e.g., pipe) stick and subsequently slip, a system can go from essentially no WOB or rate of penetration to too much WOB. This can result is undesirable drilling complications and inefficiencies (e.g., a damaged downhole assembly).

Stick slip is particularly prevalent in directional drilling. Directional drilling typically involves directing the path of a wellbore by controlling the orientation of a drilling assembly (e.g., a bent-axis motor bit assembly) during a drilling operation. The orientation of a drill bit for directional drilling is typically biased in a particular direction. More specifically, the associated tool face is configured to guide the drill path along a particular curve. However, rotating the attached drill string can change the orientation of the tool face and essentially override the bias. Traditionally, when drilling a straight hole, the drill pipe is rotated within the borehole to cause straight-line drilling. This rotation of the drill pipe also generally results in avoidance of stick slip issues. Indeed, the rotation of the drill pipe during straight line motion breaks static friction and allows slippery dynamic friction to take over, which facilitates freely sliding the drill pipe through the borehole and keeping a constant force on the drill bit.

However, when creating a curved portion of a directional drill hole, the drill pipe is traditionally not rotated. This allows an operator to steer the drilling by identifying an orientation of the drill bit and drilling when the desired direction corresponds to a bias of the drill bit. The lack of rotating the drill pipe during this steering operation allows the drill bit to direct the drilling in a curved manner, but also makes the process more susceptible to static friction. As the drill pipe begins to stick and bind in the borehole due to static friction, it becomes difficult to keep a consistent force on the bit. Thus, additional force may be applied until the static friction is overcome, which can result in undesirable jerking motions referred to as stick slip. Similar issues may occur when a large length of pipe is downhole, which may cause increased friction due to the length of pipe and associated surface area.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
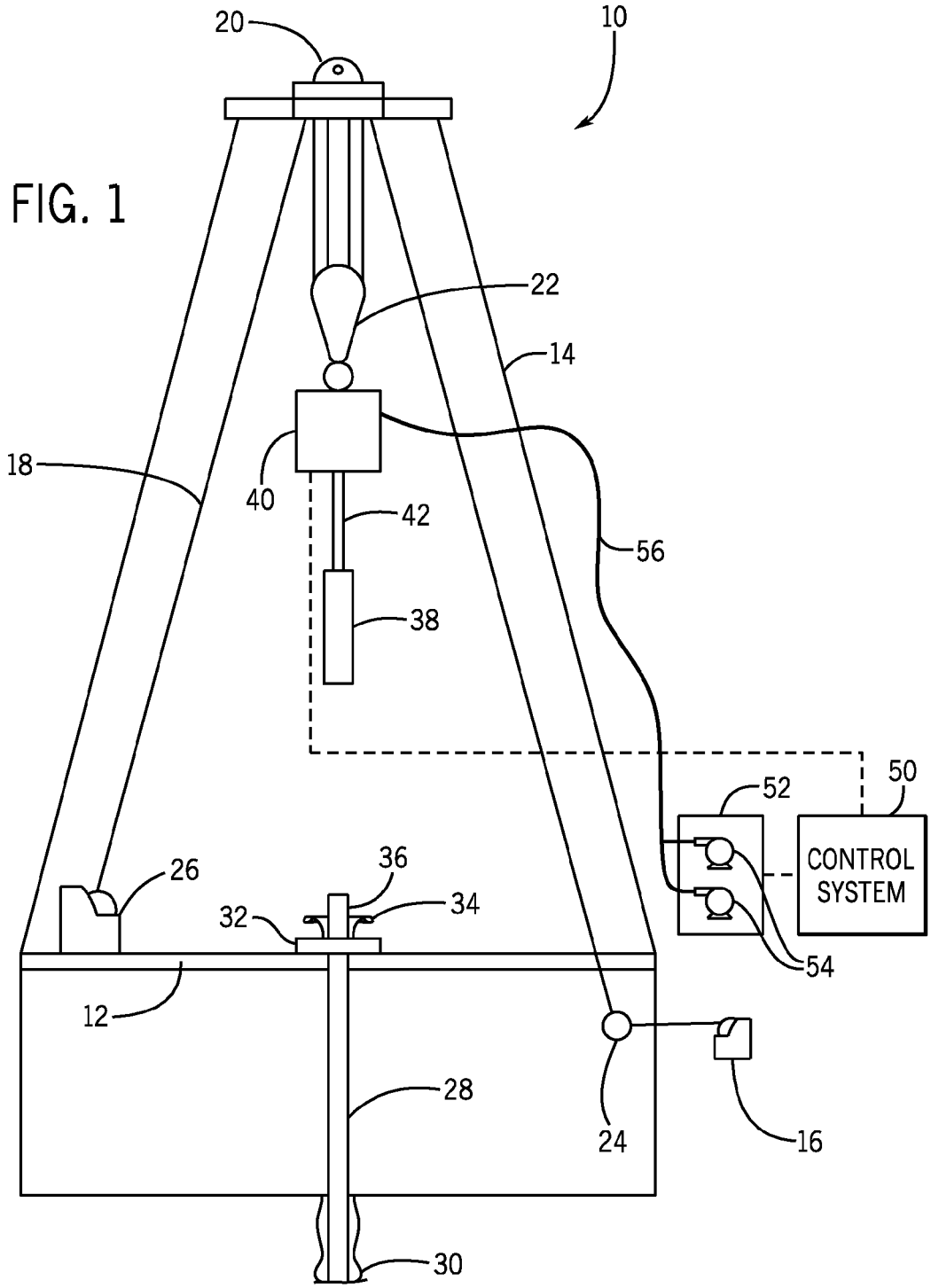
FIG. 1 is a schematic of a drilling rig in the process of drilling a well in accordance with present techniques.

Various drilling techniques can be utilized in accordance with embodiments of the present disclosure. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a drive system may rotate the drill string to facilitate drilling. A drive system typically includes a rotational feature (e.g., a drive shaft or quill) that transfers torque to a drill string. For example, a top drive may generate torque and utilize a quill to transfer the torque to a drill string. In accordance with present embodiments, a drive system may operate to rotate a drill string through variable angular displacements (the angle through which a point is rotate) and at variable rotation speeds based on control signals received by the drive system. Top drives are typically utilized in well drilling and maintenance operations, such as operations related to oil and gas exploration. The drill string may include multiple sections of tubular, including coiled tubing, that are coupled to one another by threaded connections or tool joints. These joints may frictionally engage edges of the wellbore.

During certain portions of a drilling operation, frictional engagement of the drill string with the borehole may cause the drill string to stick and prevent force applied to the top of the drill string from reaching the drill bit. This can result in stick slip issues. Present embodiments are directed to addressing stick slip issues using various techniques. In one embodiment, variables associated with drill string motion (e.g., pipe length, pipe stiffness, coefficient of friction in the hole, shape of the hole, rotation speed, pipe rotation amount, and mud motor torque) are utilized to determine an amount of motion that can occur at a top drive quill attached to the drill string to achieve a desired depth for which the drill string can be made to rotate (a reach of motion caused by applying torque to the drill string with the top drive), which can be used to achieve a desired WOB. Further, present embodiments include quill oscillation correction techniques to address delayed offset detection. Indeed, due to delays between measurement updates from downhole (e.g., mud pulse feedback from a downhole tool), which may generally be received at 14 to 120 second intervals, present embodiments operate to make mid-rotation corrections such that the quill is constantly being rotated to an essentially undetermined angle based on newly received information. Indeed, a rotation may not be completed to an initial target angle (or velocity) because the angle (or velocity) target changes based on updated information during rotation. Also, present embodiments may function to rotate at a higher speed through the first percentage (e.g., 60%) of an estimated or determined oscillation and then rotate at a reduced speed through the remaining or an updated part of the oscillation. In yet another embodiment, stick slip issues are addressed by rotating the drill string based on velocity profiles (e.g., alternating forward and reverse velocity profiles). By employing such velocity profiles, it is believed that a waveform may be generated through the drill string to facilitate breaking the static frictional engagement between the drill string and wellbore. The velocity profiles may be independent of an ending angle. Indeed, two substantially different velocity profiles may be utilized in accordance with present embodiments to provide the same wave energy and propagate a wave the same distance. Each of these embodiments may function together or separately to facilitate drilling operations and/or compensate for issues such as stick slip.

With respect to embodiments that operate a control system to control oscillation based on velocity profiles, the velocity profiles may ramp up to a value (e.g., a set point) and then ramp down to a value (e.g., zero) and this may be employed in forward and reverse directions. Essentially, this can include targeting the differential of an angle such that the control system is chasing a specified velocity at any point in time. The velocity profiles would ramp up from zero and reach a predetermined set point and then ramp down to zero. Certain parameters may be utilized based on the velocity profile to maximize the amount of time at which a majority of the WOB is held. The maximum velocity will generally be constrained by the rotational equipment of a given drilling system employing present embodiments.

With regard to employing velocity as a set point, when generating a wave along a lengthy component (e.g., a drill string, cable or rope), the distance of reciprocation generally has less impact than the speed of the reciprocation with respect to providing the energy needed to propagate the wave to a given distance along the length. To have an oscillating wave travel down the length to a desired point, the wave must be induced with enough energy to overcome the associated friction. Present embodiments use a velocity profile to provide energy to a wave, which propagates the wave down to a desired point along the drill path. This velocity profile is not dependent on an ending angle. Indeed, two different velocity profiles can provide the same wave energy and propagate a wave the same distance. Further, the wave front may be traveling in a different direction than the end of the wave.

The speed of reciprocation may be determined based at least partially on a distance through which it is desirable to propagate a wave. If the friction in the system is known, measurable, or can be reasonably estimated, the velocity profile can be calculated such that a torsional wave will propagate to the neutral friction point of the drill string so as to break the static friction into a dynamic regime without affecting the tool face position (and thus without affecting the direction of drilling). Depending on the length of the drill string, certain waveforms may be generated in the drill string that are sufficient to dislodge a portion of the drill string from a static frictional engagement with the borehole without impacting the position of portions of the drill string further downhole.

It should be noted that a velocity profile might be determined in various different ways in accordance with the present disclosure in order to obtain desired results (e.g., propagation of a wave to a desired location along the drill string). For example, the well data and/or user inputs may be utilized to calculate velocity targets over a time period that establish a velocity profile for rotation of the drill string. As another example, a lookup table may be utilized to identify a velocity profile based on certain input data (e.g., sensor measurements and/or user inputs). Further, as another example, a velocity profile may be calculated based on a number of variables or hunted using a hunting algorithm. Control system devices, such as automation controllers, may be programmed to perform such tasks (e.g., calculations) during operation in accordance with the present disclosure.

FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. The drill string 28 may include multiple sections of threaded tubular 38 that are threadably coupled together. It should be noted that present embodiments may be utilized with drill pipe, casing, or other types of tubular.

During operation, a top drive 40, hoisted by the traveling block 22, may engage and position the tubular 38 above the wellbore 30. The top drive 40 may then lower the coupled tubular 38 into engagement with the stump 36 and rotate the tubular 38 such that it connects with the stump 36 and becomes part of the drill string 28. Specifically, the top drive 40 includes a quill 42 used to turn the tubular 38 or other drilling equipment. After setting or landing the drill string 28 in place such that the male threads of one section (e.g., one or more joints) of the tubular 38 and the female threads of another section of the tubular 38 are engaged, the two sections of the tubular 38 may be joined by rotating one section relative to the other section (e.g., in a clockwise direction) such that the threaded portions tighten together. Thus, the two sections of tubular 38 may be threadably joined. During other phases of operation of the drilling rig 10, the top drive 40 may be utilized to disconnect and remove sections of the tubular 38 from the drill string 28, as is illustrated in FIG. 1. As the drill string 28 is removed from the wellbore 30, the sections of the tubular 38 may be detached by disengaging the corresponding male and female threads of the respective sections of the tubular 38 via rotation of one section relative to the other in a direction opposite that used for coupling.

While FIG. 1 illustrates the drilling rig 10 in the process of adding the tubular 38 to the drill string 26, as would be expected, the drilling rig 10 also functions to drill the wellbore 30. Indeed, the drilling rig 10 includes a drilling control system 50 in accordance with the present disclosure. The control system 50 may coordinate with certain aspects of the drilling rig 10 to perform certain drilling techniques. For example, the drilling control system 50 may control and coordinate rotation of the drill string 28 via the top drive 40 and supply of drilling mud to the wellbore 30 via a pumping system 52. The pumping system 52 includes a pump or pumps 54 and conduit or tubing 56. The pumps 54 are configured to pump drilling fluid downhole via the tubing 56, which communicatively couples the pumps 52 to the wellbore 30. In the illustrated embodiment, the pumps 54 and tubing 56 are configured to deliver drilling mud to the wellbore 30 via the top drive 40. Specifically, the pumps 54 deliver the drilling mud to the top drive 40 via the tubing 56, the top drive 40 delivers the drilling mud into the drill string 28 via a passage through the quill 42, and the drill string 28 delivers the drilling mud to the wellbore 30 when properly engaged in the wellbore 30. The control system 50 manipulates aspects of this process to facilitate performance of specific drilling strategies in accordance with present embodiments. For example, as will be discussed below, the control system 50 may control rotation of the drill string 28 and supply of the drilling mud by controlling operational characteristics of the top drive 40 and pumping system 52 based on inputs received from sensors and manual inputs.

Figure 2:
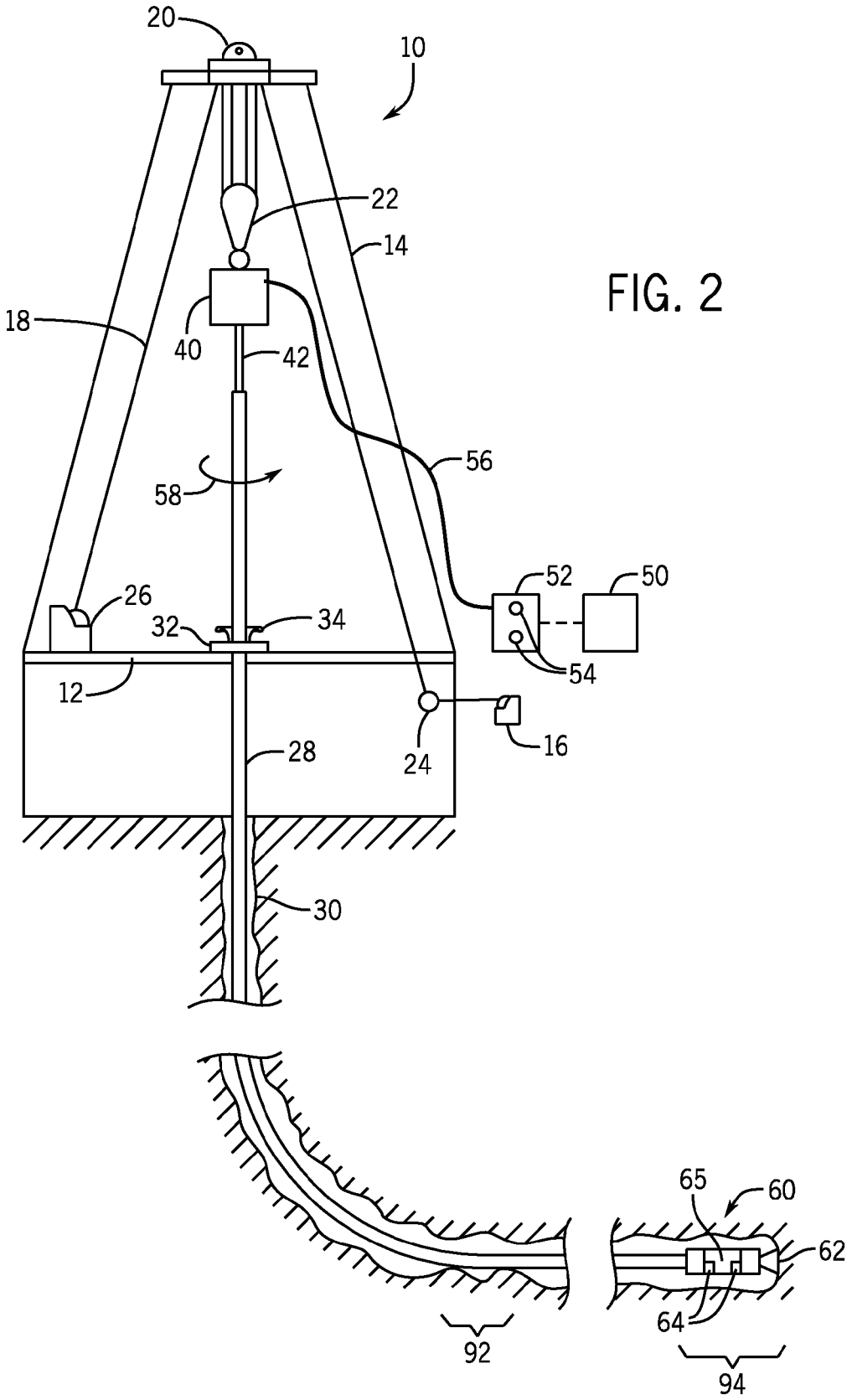
FIG. 2 is a schematic of the drilling rig in the process of directional drilling in accordance with present techniques.

FIG. 2 is a schematic representation of the drilling rig 10 during a directional drilling operation. In the illustrated embodiment, the top drive 40 is being utilized to transfer rotary motion to the drill string 28 via the quill 42, as indicated by arrow 58. In other embodiments, different drive systems (e.g., a rotary table, coiled tubing system, downhole motor) may be utilized to rotate the drill string 28 (or vibrate the drill string 28). Where appropriate, such drive systems may be used in place of the top drive 40. It should be noted that the illustrations of FIGS. 1 and 2 are intentionally simplified to focus on particular features of the drilling rig 10. Many other components and tools may be employed during the various periods of formation and preparation of the well. Similarly, as will be appreciated by those skilled in the art, the orientation and environment of the well may vary widely depending upon the location and situation of the formations of interest. For example, the well, in practice, may include one or more deviations, including angled and horizontal runs. Similarly, while shown as a surface (land-based) operation, the well may be formed in water of various depths, in which case the topside equipment may include an anchored or floating platform.

As will be discussed below, the drill string 28 may be rotated based on instructions from the control system 50, which may include automation and control features and algorithms for addressing static friction issues, such as stick slip, based on measurement data and equipment. For example, the control system 50 may control the rotation of the drill string 28 based on velocity profiles or vibration profiles generated in response to one or more variables including pipe size, size of hole, tortuosity, number of bends, type of bit, rotations per minute, mud flow, torque, bend setting, inclination, length of drill string, horizontal component of drill string, vertical component of drill string, mass of drill string, manual input, WOB, azimuth, tool face positioning, downhole temperature, downhole pressure, or the like. The control system 50 may include one or more automation controllers with one or more processors and memories that cooperate to store received data and implement programmed functionality based on the data and algorithms. The control system 50 may communicate (e.g., via wireless communications, via dedicated wiring, or other communication systems) with various features of the drilling rig 10, not limited to the pumping system 52, the top drive 40, the drawworks 26, and downhole features (e.g., a BHA).

In the illustrated embodiment, the drill string includes a BHA 60 coupled to the bottom of the drill string 28. The BHA 60 includes a drill bit 62 that is configured for directional drilling. The drill bit 62 may include a bent axis motor-bit assembly or the like that is configured to guide the drill string 28 in a particular direction. Straight line drilling may be achieved by rotating the drill string 28 during drilling, and directional drilling may be achieved by adjusting the drill bit 62 such that it guides the drilling process without rotating the drill string 28. The BHA 60 includes sensors 64 configured to provide data (e.g., via pressure pulse encoding through drilling fluid, acoustic encoding through drill pipe, electromagnetic transmissions) to the control system 50 to facilitate control of this process, including determining whether to rotate the drill string 26 via the top drive 40 and/or pump drilling mud via the pumping system 52. Indeed, the pumping system 52 may supply drilling mud to a mud motor 65 (or drilling motor) of the BHA 60. The mud motor 65, which may represent multiple such motors, may include a progressive cavity positive displacement pump arranged to generate motion and to power the drill bit 62. The sensors 64, which may represent multiple different sensors, may detect upstream and downstream pressures relative to the mud motor 65 and provide related torque data (e.g., via the control system 50). It should be noted that, in some embodiments, aspects of the control system 50 may be positioned downhole (e.g., with the BHA 60) or integrated with other features (e.g., the top drive 40).

The sensors 64 may be configured to detect and communicate well conditions and positional data. For example, the sensors 64 may be utilized to obtain data including orientation of the drill bit 62, location of the BHA 60 within the wellbore 30, pressure and temperature within the wellbore 30, rotational information, mud pressure, tool face orientation, vibrations, torque, linear speed, rotational speed, and the like. The control system 50 may receive this data and utilize it to generate an effective reach (i.e., the length at which the effect of torque from both top drive and mud motor is equal to zero) of a rotation or wave, a velocity profile, or a vibration profile that will be utilized to control rotation of the drill string 28 to avoid or address certain issues related to static friction. Specifically, for example, the control system 50 may be programmed to utilize input data to estimate the location of static friction in the system and prepare velocity profiles intended to propagate a waveform to such locations. In other embodiments, different features may be utilized to provide data, such as measurement-while-drilling, wireline instrumentation, or other monitoring devices.

As illustrated in FIG. 2, the top drive 40 is being utilized to rotate the drill string 28 during a horizontal component of the drilling operation. As noted above, it is typically desirable to cease rotation of the drill string 28 during steering along a curve to enable the drill bit 62 to guide the process. However, it is now recognized that certain controlled rotations by the top drive 40 may enable oscillation to a point along the drill string 28 above the BHA 60 that avoids substantial movement of the drill bit 62 by the top drive 40. For example, present embodiments include using the top drive 40 to generate a torsional wave that propagates through the drill string 28 to avoid issues with static friction, such as stick slip. Indeed, the top drive 40 may rotate the drill string 28 in coordination with activation or deactivation of the pumps 54 to promote specific downhole activity. Specifically, certain rotations and vibrations based on a velocity profile in accordance with present embodiments may initiate a wave through the drill string 28 to overcome static friction along the drill string 28. It should be noted that such waves might be controlled such that they do not fully propagate to the end of the drill string 28. Due to the length of the drill string 28 and other factors, the drill string 28 and friction may absorb some of the motion. Thus, the wave may serve to overcome static friction at certain points along the drill string without necessarily changing the orientation of the drill bit 62. For example, a wave may be propagated through the drill string 28 to a location 92 identified as being a source of static friction without substantially impacting the orientation of the BHA 60 at a location 94 further downhole. Including forward and reverse components of the velocity profile may encourage this characteristic of operation. As will be further discussed below, torque from the mud motor may be taken into account and a neutral portion of the drill string 28 may be defined by limiting the reach of torque applied and the propagation of a related wave by the top drive 40.

As noted above, wave propagation through the drill string 28 may facilitate overcoming or avoiding frictional issues in the downhole environment, such as stick slip. Such wave propagation may be achieved based on rotational velocities of the drill string 28. The control system 50 may target velocities of rotating the quill 42, the drill string 28, the BHA 60, or the like to achieve desired results. The rotational velocity being controlled may be measured by sensors (e.g., sensors 64) disposed at essentially any point along the drill string 28 or by sensors that monitor the rotation of drive system components (e.g., the quill 42). Indeed, the rotational velocity being controlled may include a combination (e.g., an average) of various different rotational velocities. The distance of reciprocation is less important than the velocity of the reciprocation with respect to propagation over a desired length of pipe. In a particular embodiment in accordance with the present disclosure, a forward velocity profile may be carried out, followed by a reverse velocity profile. A velocity profile may be described as a controlled rotation speed of the drill string 28 or drive system (e.g., top drive 40) over a period of time. For example, FIGS. 3 and 4 include different velocity profiles 200 and 300 that may be utilized in accordance with present embodiments. In other embodiments, vibration profiles that are not necessarily dominated by a rotational component may also be utilized.

Figure 3:
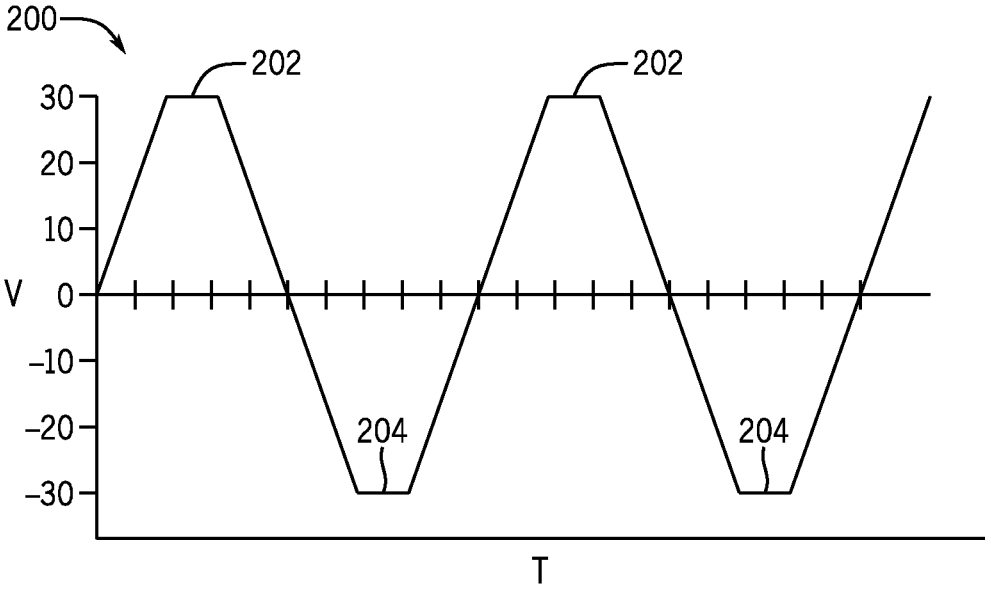
FIG. 3 is a velocity profile for control of a drive system in accordance with present techniques.
Figure 4:
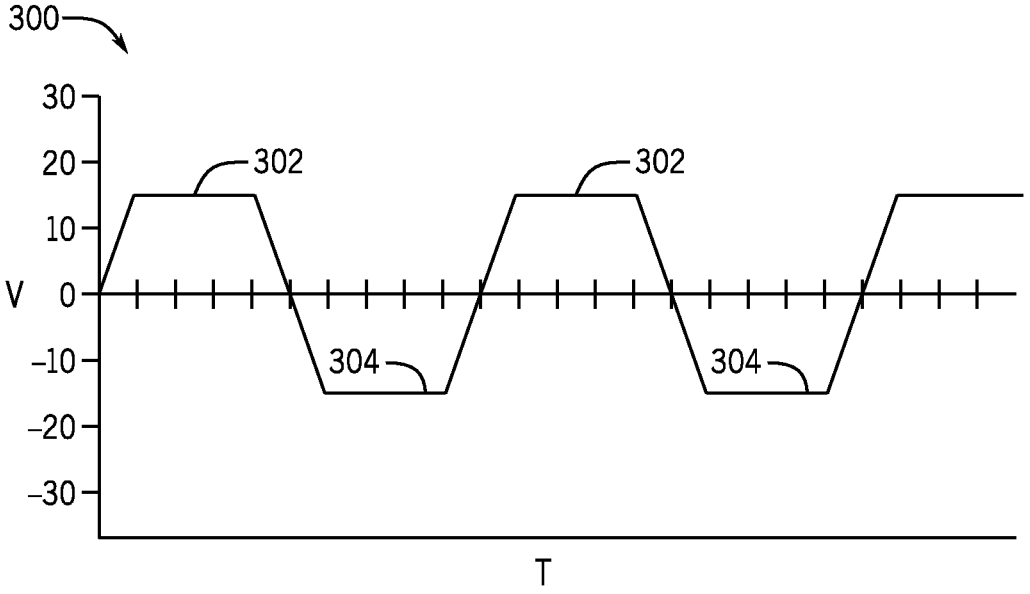
FIG. 4 is a velocity profile for control of a drive system in accordance with present techniques.

The velocity profiles 200 and 300 represented in FIGS. 3 and 4, respectively, are presented as plots of velocity (V) on a Y-axis versus time (T) on an X-axis. The velocity represents a rotational velocity of the quill 42 or some component of the drill string 28. The velocity profiles 200 and 300 are both somewhat sinusoidal. It should be noted that positive velocities represent clockwise rotation velocities and negative velocities represent counter-clockwise rotation velocities.

The velocity profile 200 includes certain velocity maximums 202 and minimums 204. Similarly, the velocity profile 300 includes certain velocity maximum 302 and minimums 304. These maximums 202, 302 and minimums 204, 304 may be limited by set points or by the capabilities of rotational equipment for a given drilling rig. For example, a set point may maintain a maximum velocity for a desired amount of time, which results in the flattened wave portions at the extremes of the velocity profiles 200, 300. The flattened wave portions may also be the result of technical limitations. For example, the velocity profile 300 may be limited to lower magnitude velocities than the velocity profile 200 due to limited capabilities of the top drive 40.

While the example velocity profiles 200, 300 are generally sinusoidal, different arrangements may be utilized. It is presently recognized that it may be desirable to have substantially equal velocity profiles in both negative and positive directions to limit the potential for reorientation of the drill bit 62. Rather than gradual adjustments, stepped increments may be utilized. Also, rather than flattened peaks, flowing peaks may be utilized wherein the maximum is only maintained briefly. Further, a gradual offset of controlled velocity in a particular rotational direction may also be desirable. For example, a series of amplitudes may build in both or a single rotational direction. It may also be desirable to adjust the period of the waves associated with the velocity profiles 200, 300 and other wave components. For example, it may be desirable to gradually increase the length of time that a magnitude of the velocity profiles 200, 300 is maintained to encourage wave propagation or building of waves in the drill string 28. Indeed, any number of different velocity profiles may be desirable to achieve certain downhole maneuvers to address stick slip and so forth.

Figure 5:
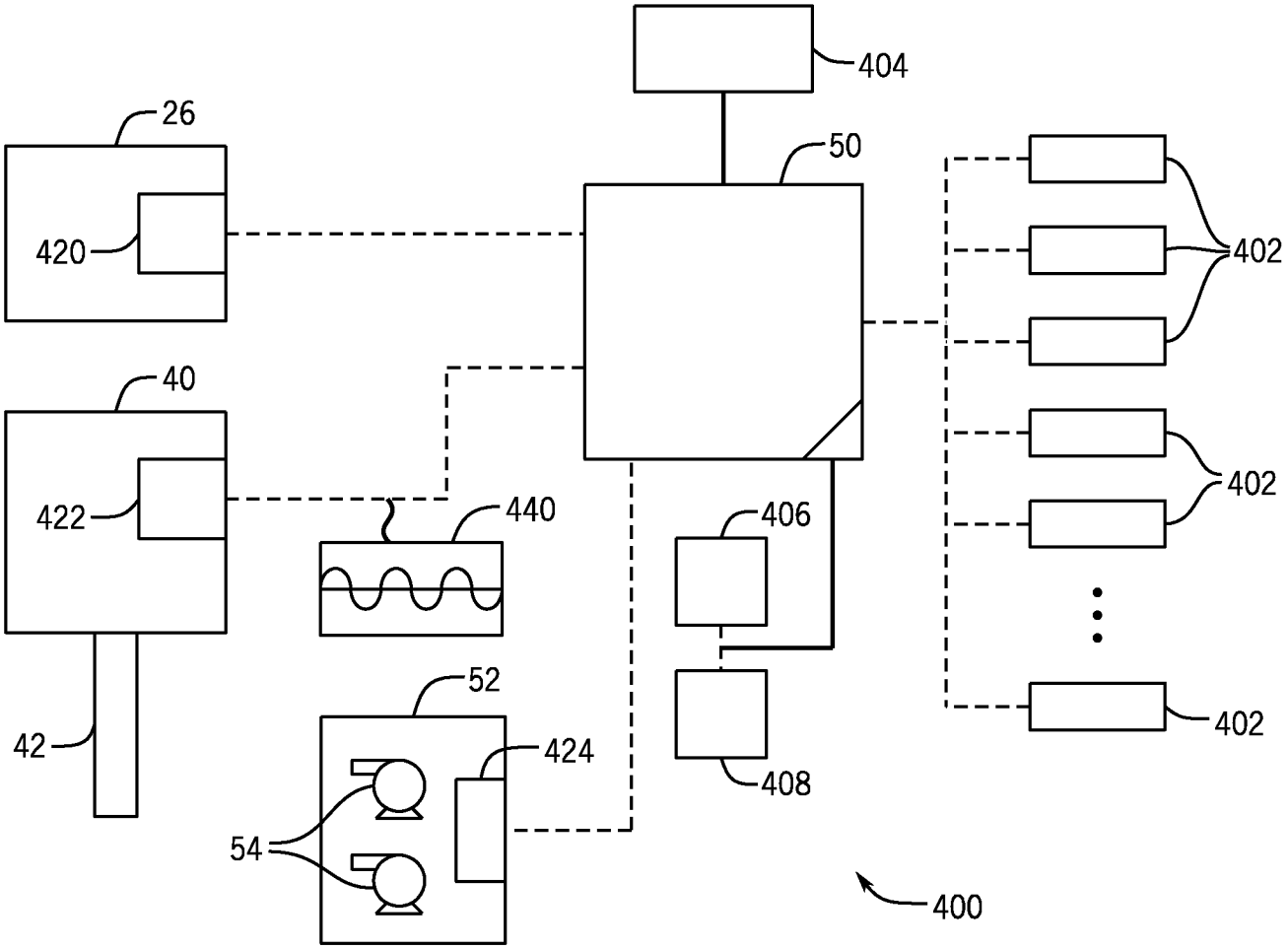
FIG. 5 is a control system configured to generate velocity profiles for control of a drive system in accordance with present techniques.

FIG. 5 is a block diagram of a drilling system 400 in accordance with present embodiments. The drilling system includes sensors 402, a user interface 404, the control system 50, the pumping system 52, and the drawworks 26. In some embodiments, different features of the drilling rig 10 may be included in the control system 400. In operation, the sensors 402 (e.g., sensors 64) of the control system 400 are disposed at various locations throughout the drilling rig 10 and are configured to transmit data (e.g., measurement data) to the control system 50. For example, data may include location data (e.g., location of the drill bit 62, positioning of drilling line 18, torque applied by the mud motor 65) and other measurements (e.g., downhole temperature and pressure). The control system 50, which may include one or more automation controllers (e.g., a programmable logic controller), is configured to receive data from the sensors 402 along with data or user-input from the user interface 404 (e.g., a keyboard or touchscreen). The control system 50 is configured to process the data from the sensors 402 and/or user interface 404 using at least one processor 406 and at least one computer-readable medium or memory 408 (e.g., a hard drive or flash memory) that is non-transitory (not a carrier wave or signal).

In the illustrated embodiment, the control system 50 generates control data for the drawworks 26, the pumping system 52, and the top drive 40. However, in other embodiments, the control system 50 may only generate control data for the top drive 40 or the control system 50 may generate control data for a large number of rig components. Specifically, in the illustrated embodiment the control system 50 provides control data to a drawworks drive 420, a quill drive 422, and a pump drive 424. These drives 420, 422, 424 (e.g., variable speed drives) may utilize the control data from the control system 50 to manipulate mechanical features of the corresponding features to perform in a specific manner. For example, the control system 50 and the drawworks drive 420 may cooperate to control a speed and amount of extension or retraction of the drilling line 18. Similarly, the control system 50 and the pump drive 424 may cooperate to activate, deactivate, or control the speed of operation of the pumps 54. Further, the control system 50 and the quill drive 422 may cooperate to control the rotation of the quill 42.

Turning specifically to the control of the quill drive 422, the control system 50 may generate a velocity profile 440 that is supplied as control data to the quill drive 422. The velocity profile 440 (e.g., velocity profiles 200 and 300), which may include a series of individual speed instructions provided over time, may be generated based on data from the sensors 402 and/or the user interface 404. For example, the control system 50 may receive inputs and calculate the velocity profile 440 based on a programmed algorithm stored on the memory 408 or select the velocity profile 440 based on a table of data stored on the memory 408. The velocity profile 440 may be generated to facilitate overcoming static friction downhole and facilitating progression of drilling during directional drilling. In operation, the top drive 40 may utilize the velocity profile to control rotation speeds of the quill 42, and, thus, initiate propagation of a waveform through the drill string 28. As previously noted, the rotation speed being controlled may be based on sensing a rotational speed of the quill 42 itself or of rotational speeds measured at one or more locations along the drill string 28. As can be appreciated, portions of the drill string 28 that are deep downhole may not rotate in synchronization with the quill 42 due to torsion and so forth. By controlling the direction and velocity of quill rotations, present embodiments may be utilized to overcome issues related to stick slip.

Figure 6:
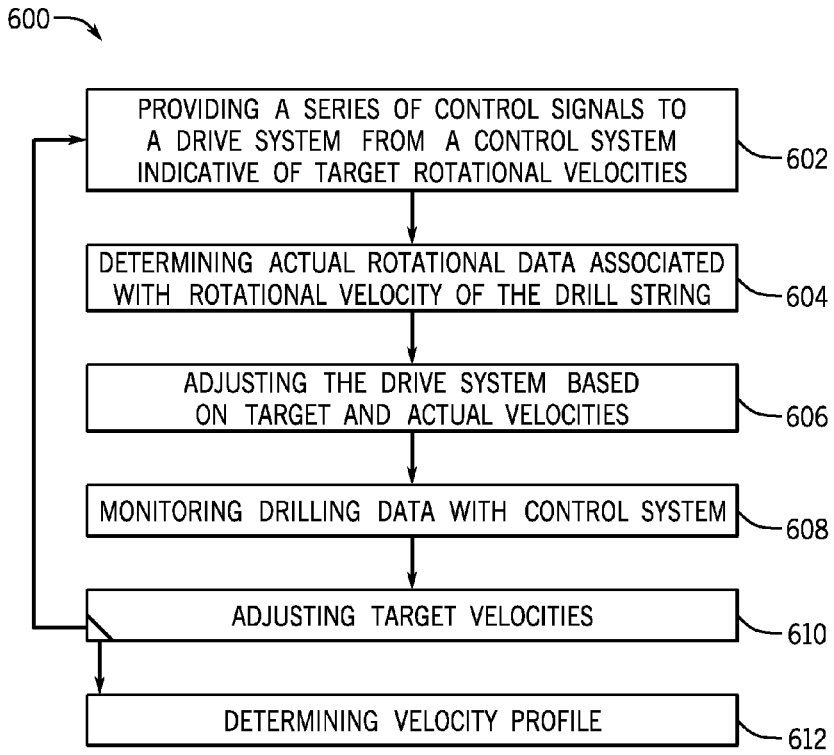
FIG. 6 is a method for controlling a drive system based on a velocity profile to propagate a wave to address static friction in accordance with present techniques.

A method in accordance with present embodiments includes controlling a drive system (e.g., the top drive 40) to rotate a drill string (e.g., via the quill 42) to achieve a series of desired rotational speeds in different directions in order to address stick slip issues. FIG. 6 is a block diagram of a specific method 600 in accordance with present embodiments. While the method 600 includes certain procedures that are employed in accordance with present embodiments, other embodiments may include additional or fewer procedures. Specifically, method 600 includes providing 602 a series of control signals from a control system to a drive system, wherein the control signals indicate desired or target rotational velocities for a portion of a drill string, which may correspond to rotational velocities of a quill of a top drive. Over time, the control signals vary in direction and magnitude such that a velocity profile is established. Such a velocity profile may be predefined or determined by the series in essentially real-time. The method 600 also includes determining 604 (e.g., sensing) actual rotational data associated with rotational velocity of the drill string and adjusting 606 the drive system based on whether the actual velocities are above or below the target velocities. This and other data is monitored 608 by the control system. Further, the control system may utilize the data to adjust 610 the target rotational velocities and/or identify different predetermined velocity profiles. This may include determining 612 (e.g., calculating or looking up based on known or identified friction within the system) a velocity profile such that a torsional wave will propagate to a neutral friction point on the drill string so as to break the static friction into a dynamic friction regime without effecting a tool face position for drilling purposes (e.g., directional steering). The neutral point may be predefined by a user to establish a buffer between torsional regimes based on activity of the top drive 40 and activity of the mud motor 40, as will be discussed in further detail.

Figure 7:
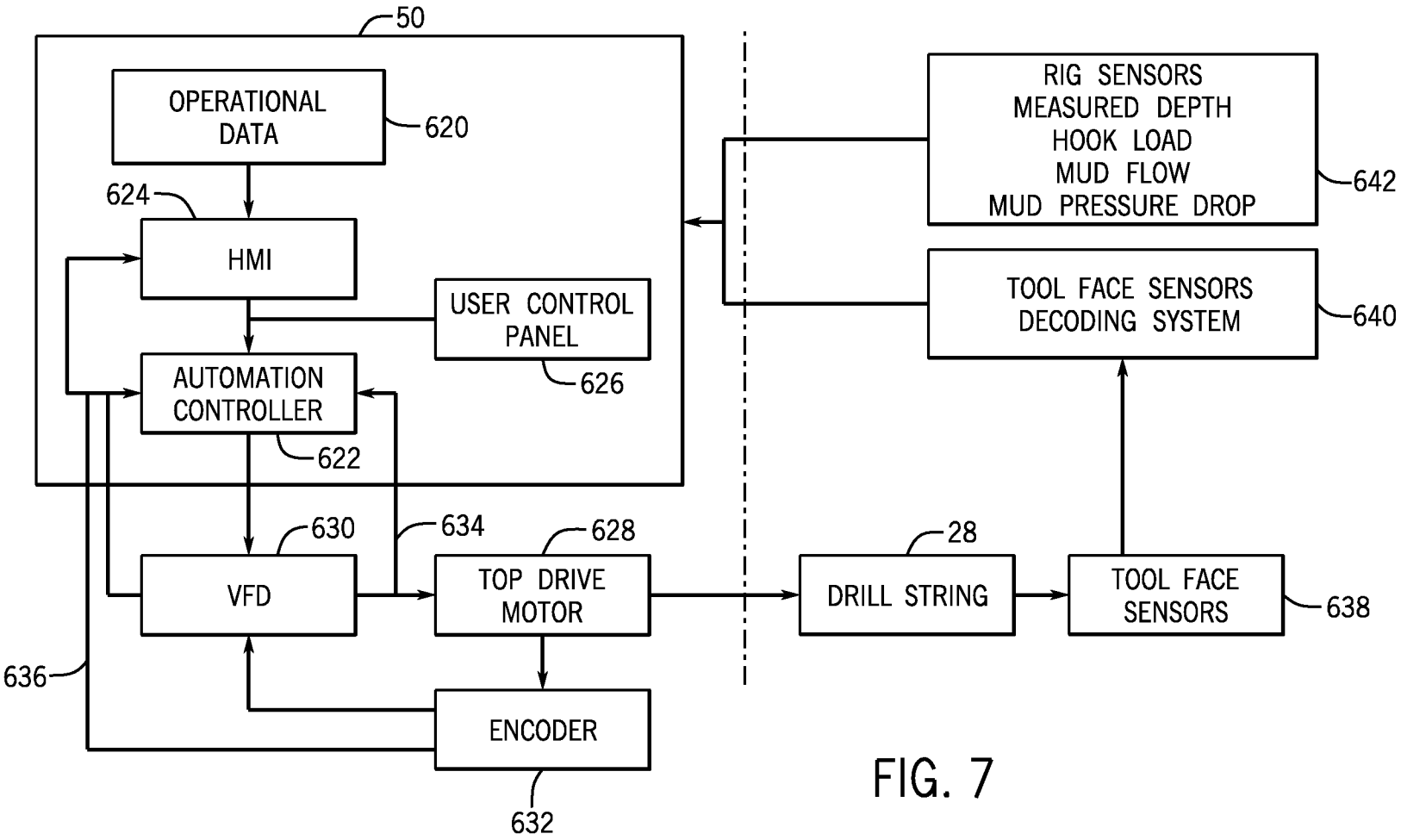
FIG. 7 is a block diagram of control features and a control scheme in accordance with present techniques.

FIG. 7 is a block diagram of a control features and a control scheme in accordance with present embodiments. Such a control scheme may include program instructions stored on a tangible, computer-readable, non-transitory (not a signal or carrier wave) medium (e.g., a hard drive of a computer). The control scheme may be utilized to control oscillation of the drill string 28 at a desired depth by determining and implementing a corresponding amount of motion at the quill 42 based on variables associated with pipe motion. In particular, such a control scheme can be utilized to set an effective reach for rotation. That is, a control system (e.g., control system 50) utilizing an embodiment of the illustrated control scheme may be capable of setting a desired rotation depth as an input for control. This effective reach may take into account a length of the drill string 28 at the bottom of the hole that should remain stationary during oscillation of the upper portion of the drill string 28 and the associated reactive torque (e.g., the amount of torque generated by the mud motor 65). For example, the effective reach may be limited to avoid rotation of the drill string beyond a certain depth and to provide a neutral buffer between upper and lower torqued portions of the drill string 28.

The length of the drill string 28 that should not be oscillated by the top drive 40 may be determined based on the torque of the mud motor 65, which may be determined based on detecting a pressure drop across the mud motor 65. Further, a distance gap may be established between reactive torque and the active oscillation torque or surface torque (e.g., the amount of torque generated by the top drive) such that an associated velocity profile and subsequent rotation is automatically adjusted as the measured drilling depth increases. Accordingly, stick slip in an upper portion of the drill string 28 may be addressed while allowing the drill bit 62 to remain essentially unaffected by the controlled oscillations associated with the surface torque.

As illustrated in FIG. 7, operational data 620 (e.g., well formation, well path, and drill string mechanical data) may be provided to an automation controller 622 (e.g., a programmable logic controller) via a human-machine interface (HMI) 624 (e.g., a software package on a personal computer) or the like. Provision of certain values in this manner (e.g., uploading well data to the operational data 620 before the well is drilled) may facilitate the use of determinations of torque and drag in ensuring velocity profiles change as the measured depth is increased, as will be discussed further below. A user control panel 626 or various input ports may also be used to provide input to the automation controller 622. The operational data 620, the automation controller 622, the HMI 624, and the user control panel 626 may each be components of the control system 50. In other embodiments, the control system 50 may include additional or fewer components. Indeed, in some embodiments, aspects of the control system 50 may be positioned downhole (e.g., on the BHA 60) during operation.

One or more components of the control system 50 may perform certain torque and drag calculations or determinations (e.g., using lookup tables, value hunting algorithms, or iterations). For example, torque and drag determinations may be performed or provided via the HMI 624, a related computer, or provided in the operational data 620. The determined torque and drag values are used to facilitate rotational control of the drill string 28 by controlling a top drive motor 628 via a variable frequency drive (VFD) 630, which receives feedback from the top drive motor 628 through an encoder 632. It should be noted that control of the mud motor 65 may also be implemented based on similar measures. Certain operations of the automation controller 622 may also be based on torque feedback 634 provided from a sensor associated with the quill 42, the VFD 630, or the top drive motor 628. The automation controller 622, the HMI 624, the VFD 630, and the encoder 632 are shown as being in communication with one another in the illustrated embodiment. Indeed, in the illustrated embodiment, the VFD 630 is shown providing the torque feedback 634 and the encoder 632 is shown providing quill speed and position feedback 636 directly to the HMI 624 and the automation controller 622. In other embodiments, other features may also be in communication with one or both of the HMI 624 and automation controller 622.

As generally discussed above, the illustrated scheme of FIG. 7 facilitates determining and setting an effective reach of surface torque and/or control of a gap or distance setting between reactive torque and surface torque along the drill string 28. The calculations associated with these settings and determinations are based on certain known values and measurements (e.g., pipe length, pipe stiffness, coefficient of friction in the hole, shape of the hole, rotation speed, pipe rotation amount, and mud motor torque). Certain of these values are obtained from the sensors 64, which may include tool face sensors 638 that detect pressure differential across the mud motor 65 and the like. The tool face sensors 638 may take measurements, which are provided to the control system 50 via a tool face sensor decoding system 640. Other inputs 642 (e.g., rig sensors, measured drilling depth, hook load sensors, mud flow sensors, mud pressure drop sensors) and so forth may also provide information to the control system 50 to facilitate determinations related to torque, gap settings, and effective reach.

Calculating drill string torque and drag facilitates drilling analysis and control in accordance with present embodiments. As generally set forth above, surface torque may be defined as the amount of torque generated by the top drive on the drill string. Accordingly, the surface torque for the entire drill string (drill string surface torque) may be defined as the moment required to rotate the entire drill string 28 and the bit on bottom 62. This moment may be used to overcome the rotational friction of the drill string 28 against the wellbore 30, the viscous force between the drill string 28 and the drilling fluid, and the bit torque. The drag may be defined as the force required for pulling or lowering the drill string 28 through the wellbore 30. This force may be used to overcome axial friction between the drill string 28 and the wellbore hydrodynamic viscous force between the drill string 28 and the drilling fluid.

Known torque and drag equations may be utilized in accordance with present embodiments to define hook loads for lifting (pulling) and lowering operations. Such equations may also be utilized to define the torque for the drill string 28 in the wellbore 30. The use of these known equations or models will be discussed below to summarize techniques that may be employed in accordance with present embodiments. It will be appreciated that those of ordinary skill in the art will understand the nature and use of the known aspects of these models or techniques in view of the following description, which incorporates such techniques as aspects of present embodiments.

A first model for determining torque and drag includes a soft string model, which does not account for stiffness effects. With respect to this model, two sets of equations may be utilized in accordance with present techniques, one set for straight sections of the drill string 28 and another set for curved sections of the drill string 28. First, torque and drag along a straight section will be discussed. Second, torque and drag along a curved section will be discussed. As will be understood, the equations and procedures discussed may be implemented by equipment performing or including schemes, programs, and procedures in accordance with present embodiments.

For drag along a straight section of the drill string 28, a friction model (e.g., the Coulomb friction model) may be used. For example, considering a drill string element with a length ΔL, the force for movement of the element may be defined by the following:

$$\Delta F=\beta w\Delta L(\cos\alpha\pm\mu\sin\alpha) \qquad \text{(Equation 1)}$$

where β is a buoyancy factor defined by the type of drilling mud being used, μ is the coefficient of friction, and α is the wellbore inclination in radians (if α is 90 degrees, the drill string element is horizontal). The first term in Equation 1 may be referred to as the weight of the drill string element. The second term in Equation 1 may be referred to as the additional friction force required to move the drill string element. With respect to the plus or minus sign, addition corresponds to lifting the drill string element while subtraction corresponds to lowering the drill string element.

With respect to the friction coefficient, μ, it should be noted that there are two approaches to performing the torque and drag calculations. In one approach, a single fiction coefficient may be assumed for the entire well (including both cased and open sections) based on establishing a correspondence with measured hook loads. In a second approach, distinct friction coefficients may be assumed for each of cased and open sections of the well.

In light of Equation 1, a general equation for a straight section of the drill string 28, which consists of n sections of different pipe can be expressed as follows:

$$\Sigma_{i=2}^{n}F_i=\Sigma_{i=2}^{n}F_{i-1}+\Sigma_{i=2}^{n}\{\beta w\Delta L\times(\cos\alpha\pm\mu\sin\alpha)\}_i \qquad \text{(Equation 2)}$$

where $F_i$ and $F_{i-1}$ respectively represent the force at the top and bottom of each drill string element, $\beta_i$ represents buoyancy factors for different mud weights that may be used to fill different sections of the well, and all of the friction coefficients, μ, can be switched based on open or cased sections.

With respect to torque calculations for a straight section of the drill string 28, the following equation may be utilized:

$$T=\mu\times\beta\Delta Lr\sin\alpha \qquad \text{(Equation 3)}$$

where r corresponds to joint radius and the other variables are previously defined. When equals to zero in a vertical section, no torque applies, whereas when equals to 90 degrees in a horizontal section, the maximum torque applies. The following equation represents the entire torque along the drill string 28 in a straight section:

$$\Sigma_{i=2}^{n}T_i=\Sigma_{i=2}^{n}T_{i-1}+\Sigma_{i=2}^{n}\{\mu\times\beta\Delta Lr\sin\alpha\}_i \qquad \text{(Equation 4)}$$

where $r_i$ corresponds to tool joint radii and $T_i$ represents bit torque. It should be noted that the drill string section under consideration may include different components with differing tool joint radii, $r_i$. Further, for i equals to 2, $T_i$ represent the bit torque.

Turning to torque and drag determinations along a curved section, additional input may be utilized. For example, values associated with depth and horizontal displacement may be measured and utilized. Indeed, at regular intervals during a drilling operation, the wellbore 30 may be surveyed to generate outputs including the wellbore inclination and geographical azimuth. Using the values of this data, depth and horizontal displacement may be calculated or otherwise determined. Furthermore, both the wellbore inclination and azimuth are determinative of a dogleg angle, q. Because the pipe of the drill string 28 will contact either the high side or low side of the curved wellbore, its contact surface is given by the dogleg plane. The dogleg angle is defined for each hole section as follows:

$$\cos\theta_i=\sin\alpha_i\sin\alpha_{i-1}\cos(\phi_i-o_{i-1})+\cos\alpha_i\cos\alpha_{i-1} \qquad \text{(Equation 5)}$$

With respect to side bends (e.g., build-up or drop-off side bends or a combination thereof), the axial force for a drill string element i equal to 2 becomes:

$$F_2=F_1\times e^{\pm\mu_2|\theta_2|}+\beta_2 w_2\Delta L_2\times\left\{\frac{\sin\alpha_2-\sin\alpha_1}{\alpha_2-\alpha_1}\right\} \qquad \text{(Equation 6)}$$

where a plus sign defines lifting of the drill string element and a minus sign defines lowering of the drill string element in a curved section. For an entire curved section the following equation for drag may be used:

$$\sum_{i=2}^{n} F_i = \sum_{i=2}^{n} [F_{i-1} \times e^{\pm \mu_i |\theta_i|}] + \sum_{i=2}^{n} \left\{ \beta_i w_i \Delta L_i \times \left[ \frac{\sin\alpha_i - \sin\alpha_{i-1}}{\alpha_i - \alpha_{i-1}} \right] \right\} \quad \text{(Equation 7)}$$

When it is assumed that the friction coefficient is neglible (i.e., zero), Equation 7 will show the static weight of the entire curved section. The torque for the bend element i equal to 2 is defined as follows:

$$T_2 = \mu_2 \times r_2 F_1 |\theta_2 - \theta_1| \quad \text{(Equation 8)}$$

The torque calculation for an entire curve section is represented by the following equation:

$$\Sigma_{i=2}^{n} T_i = \Sigma_{i=2}^{n} \mu_i \times r_i F_{i-1} |\theta_i - \theta_{i-1}| \quad \text{(Equation 9)}$$

In summary, wellbore frictions for any shape of the drill string 28 can be computed by dividing the well into straight and curved components. Forces may then be calculated for each component. The associated forces and torques may then be summed starting from the bottom of the drill string 28 and working up to the top. It should be noted that the summation of these forces and torques is based on each change in wellbore geometry or pipe size. These formula and techniques may be coded into programming and control features of the control system 50 or similar components.

The approach set forth above regarding torque and drag is based on a soft string model, which ignores any stiffness effects. Another approach includes a dynamic torque model of a stiff string. The inputs to this model are pipe type, number of pipes in each section, buoyancy factors based on mud type, friction coefficient, and top drive rotations per minute (RPM) with respect to time. The outputs of this model are torque and angular displacement of the quill and downhole. In this approach the wellbore is divided into a vertical section, a curved section, and a horizontal section. Each of these three sections is matched with an equivalent mass, spring, and damper model. Further, a friction element is positioned at the last part. Initially, the friction coefficient is an input provided by a user.

With respect to the portion of the wellbore 30 considered to be the straight section, the stiff string model calculates the effective weight based on the pipe type and number of pipes in the section. The impact of the drilling mud is taken into account using Archimedes principle. That is, the effective weight of the drill string 28 in a well filled with mud is the weight in air minus the weight of mud that the pipe material (e.g., steel) in the string displaces. Thus, the effective weight is adjusted in accordance with this by multiplying with a buoyancy factor, and the effective weight is assigned to a rotational inertia element in the model. Based on the type of pipe being used and the number of the joints in the section, which defines a length of the section, the stiff string model calculates the stiffness of the section. The stiffness is assigned to a rotational spring in the model.

Turning to the other portions of the well, with respect to the section of the well considered curved, the calculation of mass and spring generally correspond to the calculation for the straight section. However, the effective weigh is multiplied by the cosine of the inclination angle, cos(α). Turning to the portion of the well considered to be the horizontal part, there is no effect on torque with respect to this part. The horizontal part is considered to simply change the friction element. Initially, the coefficient of friction is considered to be an input from a user. In operation, the given coefficient of friction, which is entered by the user, is populated in the rotational friction element. The user also enters the desired RPM versus time and the model is initiated. The model calculates the torque due to the load, and the displacement downhole and on the surface.

Keeping the foregoing models in mind and the previously described utilization of velocity profiles, it should be noted that present embodiments may employ a velocity-based oscillation (VBO) algorithm. The VBO algorithm may be utilized to calculate the requisite degrees of angular displacement on the top drive 40 to reach zero torque at a location on the drill string 28 at a given length. The VBO algorithm first uses a known model of torque and drag, such as those discussed above. The VBO algorithm begins with the given effective reach (i.e., the length at which the effect of torque from both top drive 40 and mud motor 65 is equal to zero), and calculates torque increments for every segment of the drill string 28 being considered using the models discussed above. It may be assumed that the torque on the top of one segment is equal to the torque in the bottom of the next segment higher up, which can continue to the top of the drill string (including the top drive 40). Then, the torque identified as the torque at the top serves as the maximum torque in the top drive 40. It should be noted that maximum torque can be practically achieved by rotating until the entire drill string 28 is moving and then stopping in what would be considered a neutral starting position. Furthermore, based on the maximum torque identified in this manner, a length of the effective reach and other properties of the drill string 28 can be calculated accordingly. For example, an angle of twist, which represents the angular displacement required for the top drive 40, may be calculated based on this data.

The following is an example calculation of the angle of rotations in the top drive 40 based on assuming an effective reach of 700 meters (L=700 m) and assuming the required torque on the top drive 40 to reach zero torque at this length (according to the given properties of the well) is 12,000 Newton meters ($T_{td}$=12,000 Nm). Also, in the following example, the drill string pipe is assumed to be stainless steel with an outside diameter of 50 mm (D=50 mm) and an inside diameter of 30 mm (d=30 mm). Further, the modulus of rigidity of the stainless steel is assumed to be 90e9 Pascals (G=90e9). The torsion constant (J) is calculated as follows based on the above-listed parameter values:

$$J = \frac{\pi}{32} = \frac{\pi(0.05^4 - 0.03^4)}{32} = 534.07 \times 10^{-9}\ \text{m}^4 \quad \text{(Equation 10)}$$

Further, the angle of rotation, θ, is calculated as:

$$\theta = TL/GJ = (12{,}000 \times 700)/(90 \times 10^9 \times 534.07 \times 10^{-9}) = 17.5 \text{ radian} \quad \text{(Equation 11)}$$

and 17.5 radians coverts to 1003.18 degrees. Thus, the angle of rotation based on the values assumed above is calculated as 1003.18 degrees.

As indicated above, the presently disclosed VBO algorithm calculates the torque in a stepwise manner from the predetermined effective reach. Thus, the torque is determined from where the torque is zero up to the surface torque at the initiation point. The inputs from the well for this calculation include a number of sections (n), an inclination of each section, a friction coefficient, a pipe diameter, a pipe weight unit, a pipe length, and an effective reach length. Each of these values are typically known, can be estimated, or calculated from known or desired values. The resulting output of the VBO algorithm will be the desired amount of surface torque to implement such that a torque of zero is reached at the given effective reach length. For instance, in one example the effective reach length may be given as 102 m, which includes one pipe in a cased portion of the wellbore 30 (Zone 1), two pipes in an open hole portion of the wellbore 30 (Zone 2), one pipe in a bend section of the wellbore 30 (Zone 3), and one pipe in a horizontal section of the wellbore 30 (Zone 4). Example parameter values and results from this example are provided in Table 1 below:

TABLE 1

| Zone No. | Pipe No. | Inclination | Azimuth (R * d) | Friction Coefficient (cased, open) | Buoyancy | Pipe Dia. | Pipe Weight | Pipe Length | Bit Torque | Bit Drag |
|---|---|---|---|---|---|---|---|---|---|---|
| 1 | 1 | 0 | 45 | 0.2 | 0.9 | 0.05 | 200 | 21 | | |
| 1 | 2 | 0 | 45 | 0.4 | 0.9 | 0.05 | 200 | 21 | | |
| 2 | 3 | 0 | 45 | 0.4 | 0.9 | 0.05 | 200 | 21 | | |
| 3 | 4 | 45 | 45 | 0.4 | 0.9 | 0.05 | 200 | 21 | | |
| 4 | 5 | 90 | 45 | 0.4 | 0.9 | 0.05 | 400 | 18 | 0 | 200 |

With the foregoing in mind, it should be noted that present embodiments may include a self-diagnosis routine configured to compare predicted or calculated values with measured values and to make adjustments. Further, present embodiments may function to confirm consistency among separate calculated values. For example, a self-diagnosis component of present embodiments may function to confirm that calculated surface torque values at the uppermost level match or properly correspond to the calculated surface torque values at a given measured depth. This may facilitate more consistent operation and control of systems in accordance with present embodiments.

Figure 8:
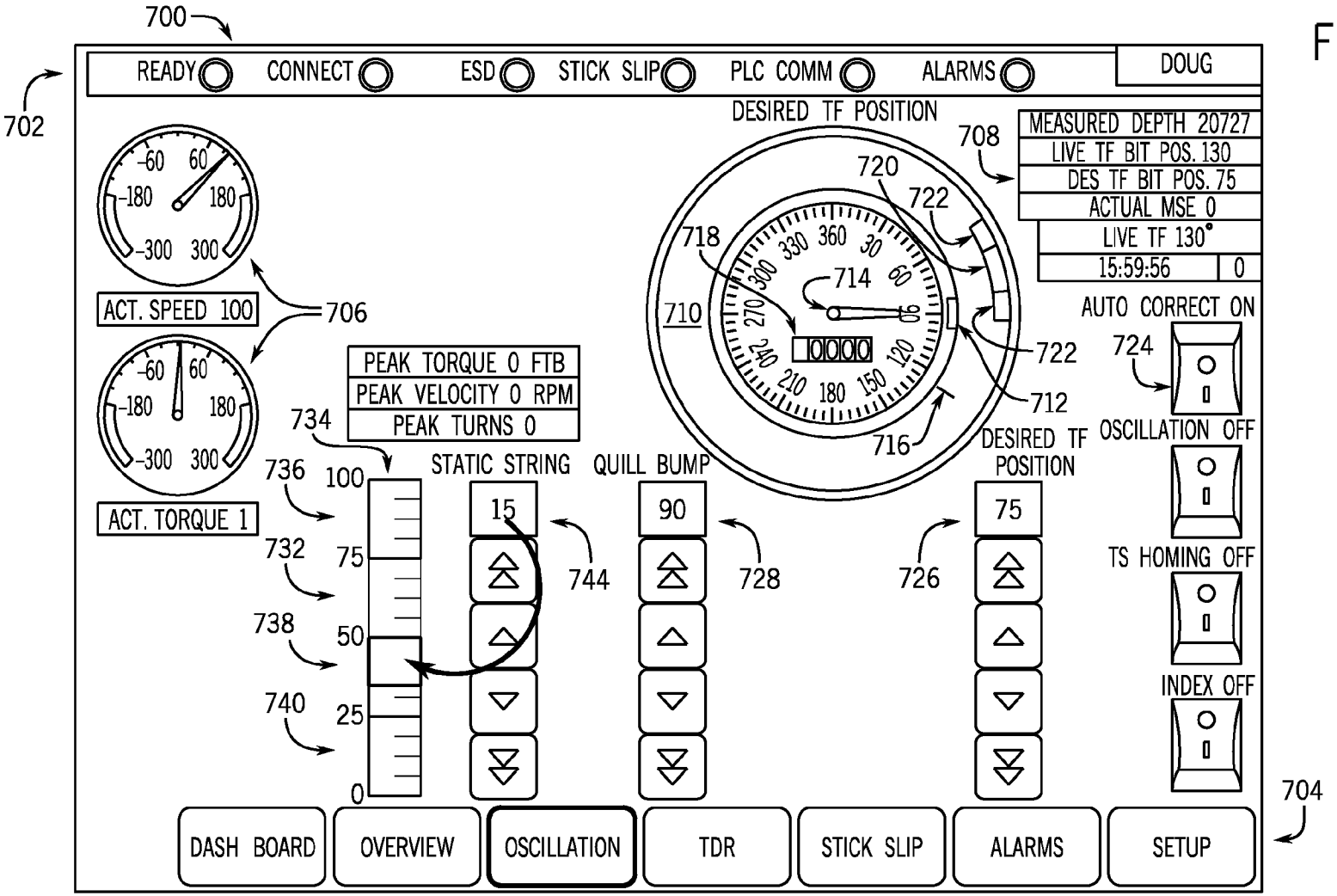
FIG. 8 illustrates a visualization displayed by a control system feature in accordance with present techniques.

FIG. 8 illustrates a visualization 700 as presented via a feature of the control system 50 (e.g., a visualization presented via the HMI 624) in accordance with present embodiments. This visualization is one example of various types of visualizations that may be provided in accordance with present embodiments. The visualization 700 includes various different status indicators, gauges, readings, buttons, and so forth. A set of status indicators 702 are provided at the top of the visualization to indicate alarms and other status values. For example, these status indicators 702 provide information as to whether a connection is enabled, whether an emergency shutdown (ESD) is active, whether stick slip is present, and the identify of a logged-in operator. Further, a set of tabs or menu buttons 704 is positioned along a lower portion of the visualization 700 and provides access to other visualizations and tools of the control system 50. Various other indicators of the visualization 700 provide measurement and setting values. For example, a set of gauges 706 provide actual speed and torque measurements, and a set of data readings 708 indicate measured well values (e.g., depth and bit position).

Among the indicators of the visualization 700 is a positioning gauge 710 which functions to provide a representation of various measurements and settings related to the quill and tool face. In some embodiments, a single visualization feature, such as the visualization 700 or a tool (e.g., gauge) within a visualization 700, includes each of a desired tool face angle, a current tool face angle, a current quill angle, a home position of the quill, and an amount of turns built up in the quill. For example, in the illustrated embodiment, the positioning gauge 710 indicates a quill home position 712, which is defined by the quill location when the drill string is fully wound. Further, the positioning gauge provides a current quill location 714, a live tool face position 716 as identified by incoming data, an indication of a number of turns of the quill 718 (e.g., based on direct measurement), a desired tool face position band 720, and boundary bands 722 outside of the desired tool face position. Present embodiments take into account torque, quill position, and tool face position.

With regard to the quill home position 712 referenced above, a homing sequence in accordance with present embodiments may be utilized to define the associated value or specific location. This sequence may begin with confirming connection, activation of drill mode, mud motor is on, slips are out, drill bit 62 is on bottom, and current rotation is zero RPM. If the above conditions are met, an operator may be allowed to engage the homing sequence by, for example, pressing a button that becomes available on the visualization. Once activated, rotation of the quill may be initiated. Further, torque may be calculated and monitored to observe any plateau before the calculated stop point. Next, when the system is fully loaded (entire drill string 28 is spinning), the quill may be stopped and associated measured parameters stored. The quill home may then be reset to zero degrees. Next, updated data may be received with respect to the tool face position. After receiving this updated data, a positive delta angle between the actual tool face and a desired tool face is calculated. If the delta angle is less than 80 degrees, the drill string is rotated to make the delta angle zero and the process is repeated starting with receiving updated data until the delta angle is zero. Otherwise, the drill string is rotated, the last stop point is adjusted to include the delta angle, and the process is returns to the step of calculating and monitoring the torque.

The visualization 700 also includes various inputs for control of the top drive 40. For example, an autocorrect button 724 can be activated to control the tool face position such that it remains within the area designated by the tool face position band 720, which may be defined based on a directional driller input tool 726. The autocorrect button 724 initiates tool face corrections (e.g., small right turn tool face corrections) that keep the tool face angle on a desired path while the drill string 28 is oscillating. However, this feature may also function when the drill string 28 is not oscillating.

The inputs may also include a quill bump input tool 728 that facilitates rapid adjustments to quill operation. The quill bump tool 726 can initiate a bump or change in the quill position (e.g., quickly turning the quill right) while the quill is in the process of oscillating. Activation of a quill bump generally adds motion to the end of an oscillation. This feature may be locked out during homing or autocorrect functions.

The visualization 700 may also include a torque management tool 732 that gives an operator a sense of how much surface torque, bottom hole reactive torque, and neutral torque is present in the drill string 28. The torque management tool 732 may also give the operator a sense of how the effect of the torque is related to the rotation or motion of the entire drill string. In the illustrated embodiment, the torque management tool 732 includes a graphic bar 734 that represents the entire length of the drill string 28. The graphic bar 734 is segmented by incremental lines to designate respective portions of the drill string 28 to facilitate reference to portions of the drill string 28 that are being exposed to certain types and levels of torque.

In the illustrated embodiment, an upper portion 736 of the graphic bar 734 is colored-coded or pattern-coded to represent the surface torque and how far it will effect rotation on the drill string 28. For example, different colors or fill patterns may reflect different levels of torque and the amount of the graphic bar 734 filled with a particular pattern or color may reflect the distance movement caused by the torque extends along the length of the drill string 28. Similarly, a middle portion 738 of the graphic bar 734 may be indicated (e.g., color and/or pattern-coded) to represent a neutral or stationary portion of the drill string 28, while a lower portion 740 may be indicated to represent the down hole reactive torque and how far it will effect rotation on the drill string 28. As previously noted, the effective reach may be designated by a user based on values obtained using the models discussed above. For example, the buffer between the surface and reactive torque (e.g., the middle portion 738 between the upper portion 736 and lower portion 740) may be defined based on a buffer input 744 (a input setting the distance between reactive and surface torque). For example, in the illustrated embodiment, an input of 15 has been provided, which corresponds to a middle portion 738 being defined as 15% of the total drill string length. Using this input, other values may be calculated or otherwise determined (e.g., hunted) based on the methods and schemes discussed above. It should be noted that the graphic bar 734 may incorporate dynamic components that represent changes occurring during drilling based on actual measurement data. For example, the various portions of the graphic bar 734 (upper, middle, and lower) may fluctuate in the visualization 700 to facilitate an operators understanding of torque interaction along the drill string 28 during operation.

Present embodiments are believed to be capable of addressing issues related to stick slip. Present embodiments utilize a velocity profile to provide energy to a wave in a drill pipe. The velocity profile propagates the wave down to a desired point along the drill path. The velocity profiles are not dependent upon an ending angle but target a velocity, which may change in the middle of an oscillation in some embodiments. In particular, present embodiments include a system and method for carrying out a forward velocity-time profile, followed by a reverse velocity-time profile. Further, present embodiments may operate to facilitate defining a neutral portion of a drill string that is not impacted by either surface or reactive torque. This enables operation based on operator designated zones of torque. Also, present embodiments accept data related to live measurements (e.g., live tool face measurement data) to adjust torque, velocity, and position curves while in motion. Accordingly, present embodiments may not oscillate to a determined angle. Rather, a rotation may be initiated based on a set point (e.g., velocity) that actually changes before any oscillation is complete. Thus, a complete oscillation may not be achieved or finished with respect to any particular angle that is initially a component of the set point.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for rotating a drill string, comprising:

a drive system configured to rotate the drill string through variable angular displacements and at variable rotation speeds based on control signals received by the drive system; and a control system configured transmit the control signals to the drive system, wherein the control system is configured to generate the control signals based on pipe characteristics within the drill string and static friction values along the drill string to establish a rotation pattern of the drive system to approach a desired effective reach of surface torque generated by the drive system on the drill string, wherein the control system is configured to generate the control signals to comprise a velocity profile along which the drive system rotates the drill string, and wherein the velocity profile comprises a series of target rotational velocities over a time period, such that the drive system follows the velocity profile to facilitate propagation of a waveform to the desired effective reach along the drill string.

2. The system of claim 1, wherein the drive system comprises a top drive configured to rotate a quill of the top drive based on the control signals.

3. The system of claim 1, wherein the control system is configured to calculate the desired effective reach based on a user-defined buffer region between a surface torque and a reactive torque generated by a mud motor at a bottom of the drill string.

4. The system of claim 1, wherein the pipe characteristics comprise user-provided, measured, or predetermined inputs of a number of pipe sections, inclination values of the pipe sections, azimuth values of the pipe sections, and pipe physical measures.

5. The system of claim 4, wherein the pipe physical measures comprise pipe diameter, pipe weight, and pipe length.

6. The system of claim 1, wherein the control system is configured to generate control signals instructing the drive system to rotate through an initial percentage of the series of target rotational velocities at a first rate and through a remaining percentage of the series of target rotational velocities at a second rate that is lower than the first rate.

7. The system of claim 1, wherein the control system is configured to generate control signals with an initial target for the series of target rotational velocities and configured to change the initial target to a secondary target for the series of target rotational velocities based on updated data from one or more sensors during rotation of the drill string.

8. The system of claim 7, comprising the one or more sensors disposed on a downhole portion of the drill string and configured to measure at least torque.

9. The system of claim 1, comprising one or more sensors configured to measure a rotational velocity of the drill string.

10. The system of claim 9, wherein the drive system comprises a top drive and the one or more sensors comprise a sensor configured to measure a rotational velocity of a quill of the top drive.

11. The system of claim 1, wherein the control system is configured to predefine the velocity profile by calculating the velocity profile or selecting the velocity profile from a lookup table based on input data, and the series of target rotational velocities are determined from the velocity profile having been predefined.

12. The system of claim 11, wherein the input data is received from sensors and/or user inputs.

13. A method of rotating a drill string, comprising:

sending a velocity profile from a controller to a drive system, wherein the velocity profile comprises a series of target rotational velocities over a time period, wherein the drive system is configured to follow the velocity profile;

measuring one or more rotational velocities along a drill string coupled with the drive system via a rotational feature; and controlling the rotational feature of the drive system based on comparing the one or more rotational velocities and the target rotational velocities to facilitate propagation of a waveform through the drill string.

14. The method of claim 13, comprising defining the target rotational velocities based on pipe characteristics within the drill string and static friction values along the drill string to approach a desired effective reach of surface torque generated via the velocity profile.

15. The method of claim 13, comprising modifying the series of target rotational velocities during operation based on updated measurements acquired from a tool face sensor of a bottom hole assembly on the drill string.

16. The method of claim 13, comprising averaging the one or more rotational velocities to define an average measured rotational velocity and controlling the rotational feature based on a comparison of the average measured rotational velocity and the target rotational velocities at times in the time period.

17. The method of claim 13, wherein measuring the one or more rotational velocities along the drill string comprises measuring a rotational velocity of the rotational feature.

18. The method of claim 17, wherein measuring the rotational velocity of the rotational feature comprises measuring a rotational velocity of a quill of a top drive.

19. The method of claim 16, comprising determining the target rotational velocities based on positional information of a downhole tool and characteristics of the drill string such that an orientation of a downhole portion of the drill string beyond a designated point or an orientation of the downhole tool is not changed.

20. A control system, comprising:

an automation controller including a processor and a memory configured to supply a drive system for rotating a drill string with rotational data based on input data that includes a desired effective reach of surface torque along the drill string from the drive system, wherein the rotational data defines rotational velocities of different directions and magnitudes to facilitate overcoming static friction associated with contact between a drill string and a wellbore, and wherein the rotational data comprises a velocity profile comprising rotational velocities of different directions and magnitudes over a time period, and wherein the drive system is configured to rotate the drill string along the velocity profile; and a display visualization configured to provide a graphic bar indicative of a measured value of the surface torque on the drill string in an upper portion of the graphic bar, a neutral torque area in a middle portion of the graphic bar, and a measured value of reactive torque on the drill string in a lower portion of the graphic bar.

21. The control system of claim 20, wherein the rotational data is configured to generate a wave that propagates through the drill string to the extent defined by the desired effective reach.

22. The control system of claim 20, comprising a top drive incorporating the automation controller.

23. The control system of claim 20, comprising sensors for detecting propagation of a wave through the drill string.

* * * * *